US008529971B2

(12) United States Patent
Modha

(10) Patent No.: US 8,529,971 B2
(45) Date of Patent: Sep. 10, 2013

(54) PACKAGING OF A STACK OF CONFECTIONERY PELLETS AND THE LIKE

(75) Inventor: Asit Modha, Middlesex (GB)

(73) Assignee: Cadbury Holdings Limited, Middlesex (GB)

( * ) Notice: Subject to any disclaimer, the term of this patent is extended or adjusted under 35 U.S.C. 154(b) by 419 days.

(21) Appl. No.: 12/681,156

(22) PCT Filed: Oct. 1, 2008

(86) PCT No.: PCT/GB2008/003317

§ 371 (c)(1),
(2), (4) Date: Aug. 4, 2010

(87) PCT Pub. No.: WO2009/044128

PCT Pub. Date: Apr. 9, 2009

(65) Prior Publication Data

US 2010/0297288 A1 Nov. 25, 2010

(30) Foreign Application Priority Data

Oct. 2, 2007 (GB) ..... 0719191.9

(51) Int. Cl.
*A23G 4/18* (2006.01)

(52) U.S. Cl.
USPC ..... 426/5; 426/108; 426/411; 426/410; 206/800; 229/87.01

(58) Field of Classification Search
USPC ..... 426/108, 5, 411, 410; 206/800; 229/87.01
See application file for complete search history.

(56) References Cited

U.S. PATENT DOCUMENTS

| | | | | |
|---|---|---|---|---|
| 1,550,966 | A * | 8/1925 | Kappes | 426/5 |
| 1,751,208 | A * | 3/1930 | Kappes | 426/5 |
| 1,865,535 | A * | 7/1932 | Meany | 426/5 |
| 2002/0146525 | A1* | 10/2002 | Huffer et al. | 428/35.3 |
| 2003/0080015 | A1 | 5/2003 | Kopecky | |
| 2006/0051457 | A1* | 3/2006 | Bougoulas et al. | 426/5 |

FOREIGN PATENT DOCUMENTS

| | | |
|---|---|---|
| CA | 2 479 492 | 2/2006 |
| WO | 2004/101375 | 11/2004 |
| WO | 2006/075231 | 7/2006 |

OTHER PUBLICATIONS

Google Dictionary, Affixed, [on line] retrieved Mar. 29, 2013, Retrieved from the Internet: URL:<http://www.google.com/webhp?sourceid=navclient&ie=UTF-8&oe=UTF-8#h1=en&gs_rn=7&gs_ri=psy-ab&pq=bonded%20definition&cp=7&gs_id=1i&xhr=t&q=affixed+definition&es_nrs=true&pf=p&sclient=psy-ab&oq=affixed+definition&gs_l=&pbx=1&bav=on.2,or.r_qf.&bvm=bv.44442042.*

Google Dictionary, Bonded, [on line], retrieved Mar. 29, 2013. Retrieved from the Internet: URL<http://www.google.com/webhp?sourceid=navclient&ie=UTF-8&oe=UTF-8#hl=en&gs_rn=7&gs_ri=psy-ab&cp=9&gs_id=q&xhr=t&q=bonded+definition&es_nrs=true&pf=p&sclient=psy-ab&oq=bonded+de&gs_l=&pbx=1&bav=on.2,or.r_qt&bvm=bv.44442042,d.dmQ&fp=ff747504a9f2830f&biw=108.*

* cited by examiner

*Primary Examiner* — Rena Dye
*Assistant Examiner* — Chaim Smith
(74) *Attorney, Agent, or Firm* — Hoffmann & Baron, LLP

(57) ABSTRACT

Packaging of a stack of confectionery pellets (12) comprises a tubular pack (30) formed from a flexible wrapper (32) and a re-closable cap member (34) mounted to one end of pack. The cap member has a base affixed to a side wall of the pack (30) and a scoop (40) attached to the base for movement between closed and open positions. The scoop (40) is shaped to act as a receptacle for holding a pellet (12) dispensed from the pack when in the open position. The wrapper (32) has a line of weakness (61) extending around all or part of the end wall region and during manufacture an inside surface of the scoop (40) is bonded to the end wall region. When the scoop (40) is first opened, the wrapper (32) tears along the line of weakness to create an opening in the pack (30) through which pellets (12) can be dispensed. A method of manufacturing the packaging is also disclosed.

8 Claims, 3 Drawing Sheets

PACKAGING OF A STACK OF CONFECTIONERY PELLETS AND THE LIKE

CROSS-REFERENCE TO RELATED APPLICATIONS

This application is the National Stage of International Application No. PCT/GB2008/003317, which designates the U.S., filed Oct. 1, 2008, which claims the benefit of GB 0719191.9, filed Oct. 2, 2007, the contents of which are incorporated by reference herein.

TECHNICAL FIELD OF THE INVENTION

The present invention relates to packaging for a stack of gum pellets.

BACKGROUND TO THE INVENTION

It is known to provide individual confectionery items in the form of pellets, pastilles, tablets or the like. For example, chewing gum can be presented in the form of pellets which have a relatively hard outer casing or shell and a soft centre. The pellets are usually shaped somewhat like a small pillow. Other confectionery products are also presented in a similar form. For example, hard boiled sweets, candies, chocolates, toffee or mints may be provided in the form of pellets or pastilles as can may other types of candy both hard and soft. For ease of reference, the terms pellet and pellets will be used hereinafter but it should be understood that these terms are intended to encompass other similar arrangements such as pastilles, tablets and the like.

The terms gum and chewing gum as used herein include bubble gum.

When packaging confectionery products in pellet form, it is known to position a number of pellets adjacent each other in a line to form a stack having a longitudinal axis which extends through all the pellets in the stack and to wrap the stack in a sheet wrapper. The wrapper is folded circumferentially about the stack so that one side edge of the wrapper overlaps another side edge and is held in place by means of adhesive to form a seal. In this arrangement, the side edges are aligned generally parallel with the longitudinal axis of the stack. The wrapper is longer than the stack of confectionery items so that the ends of the wrapper extend beyond the ends of the stack. Each end of the wrapper is folded to provide end closure flaps which overlie their respective end of the stack to form an end wall region. The flaps are usually held in place by means of adhesive so that the wrapper forms a sealed, tubular pack for the confectionery pellets.

FIG. 1 is a perspective view of a stack 10 of chewing gum pellets 12 packaged in a wrapper 14 in a conventional manner. The wrapper 14 typically comprises a single or multi-layer sheet of foil to help keep the contents fresh. Sometimes a second, inner wrapper is provided which is folded about the stack of gum pellets in a similar manner to the main or outer wrapper 14 before the outer wrapper is applied. This is referred to as "double wrapped". However, in many cases only a single wrapper is used, which is referred to as "single wrapped". Many different confectionery products are packaged in this manner.

To assist a consumer in gaining access to the confectionery items, it is common practice to provide tear guide in or on the wrapper which assists a consumer in tearing the pack along a predetermined line in order to open the package. One known form of tear guide is a tear strip 20 which extends circumferentially around the stack of confectionery items near but spaced from one end. The arrangement is such that a free end of the tear strip can be grasped by a consumer and pulled to tear the wrapper along the line of the strip to remove an end wall region 18 of the pack. This allows access to the confectionery pellets which can be removed from the packaging one at a time.

In known packaging arrangements, the tear strip 20 is spaced inwardly from the end of the stack by a distance which is roughly equivalent to the thickness of one of the pellets 12. This makes the packaging easier to manufacture and to open but it does result in a number of problems. Firstly, while the wrapper is being opened there is a risk that a first pellet 12*a* at that end of the stack, which is positioned at least partly outboard of the tear strip 20, may be lost as the end of the wrapper is removed. Secondly, once the wrapper is opened and the first confectionery item 12*a* removed, the torn end of the remaining side wall portion of the wrapper will tend to be level with or close to the outer face of the second pellet 12*b* in the stack. As a result, the wrapper cannot be re-closed so that at least the outer face of the second confectionery item 12*b* in the stack is exposed with the risk that it may become contaminated or may go soft before it is used. There is also a risk that the pellets remaining in the stack may fall out of the package which will not be effectively closed at the opened end. These problems particularly arise where the stack is single wrapped, as there is no inner wrapper to help contain and protect the pellets.

A further drawback of the known method of packaging chewing gum pellets is that it can be awkward for a consumer to remove further pellets. If the open end of the wrapper is folded over after a first or second pellet has been removed, the consumer will first have to unfold the package again before a further pellet can be removed. However, even after unfolding, the package will not be smooth making it difficult for the consumer to easily remove further pellets.

WO 2006/075231 A1 discloses packaging for a stack of confectionery products comprising a rigid container body closed at one end by means of a hinged lid.

Whilst the use of a rigid container and end closure as described in WO 2006/075231 A1 overcomes many of the problems of the prior art wrapper discussed above, the packaging is relatively expensive to manufacture. In addition, many consumers prefer the feel of a soft package, particularly where the packaging is used for gum pellets which may be carried in a consumer's pocket.

There is a need, therefore, for a packaging for a stack of confectionery pellets that overcomes, or at least mitigates, some or all of the problems with the known packaging.

There is a need in particular for a packaging of a stack of confectionery pellets that is easier to re-close and re-open than the known packaging yet which is relatively easy and cheap to manufacture.

There is also a need for an improved method of packaging a stack of confectionery pellets, which overcomes, or at least mitigates, the disadvantages of the known methods.

SUMMARY OF THE INVENTION

In accordance with a first aspect of the invention, there is provided a packaging for a stack of confectionery pellets, the packaging comprising a tubular pack formed from a flexible wrapper which encases the stack and a re-closable cap member mounted to the pack adjacent one end, the cap member comprising a base affixed to a side wall region of the pack close to said one end and a scoop attached to the base for movement between a closed position in which the scoop encloses said one end and an open position in which said one end is exposed, the scoop being configured to act as a receptacle for holding a pellet dispensed from the pack when in the open position, in which an inside surface of the scoop is bonded to an end wall region of the pack and the wrapper has a line of weakness, the arrangement being such that, on first movement of the scoop from the closed position to the open position, the wrapper tears along the line of weakness to create an opening in the pack through which pellets can be dispensed.

The base and the scoop may have engagement means configured to releasably hold the scoop in the closed position.

The base may be bonded to the side wall region of the pack.

The scoop may be attached to the base by means of a hinge for movement between the closed and open positions.

The cap member may be produced from cardboard.

The wrapper may comprise a plastic material, preferably PET.

The confectionery pellets may be gum pellets.

In accordance with a second aspect of the invention, there is provided a method of packaging a stack of confectionery pellets, the method comprising:

providing a flexible wrapper having a line of weakness;

enclosing a stack of confectionery pellets in a tubular pack formed from the flexible wrapper so that the line of weakness at least partially encircles at least part of an end wall region at one end of the pack;

providing a re-closable cap member comprising a base and a scoop movably attached to the base;

affixing the base of the cap member to a side wall region of the pack adjacent said one end of the stack such that the scoop is movable between a closed position in which the scoop encloses said one end and an open position in which said one end is exposed, the scoop being configured to act as a receptacle for holding a pellet dispensed from the pack when in the open position;

bonding an inner surface of the scoop to the end wall region of the pack, the arrangement being such that, on first movement of the scoop from the closed position to the open position, the wrapper tears along the line of weakness to create an opening in the pack through which pellets can be dispensed.

The step of providing the re-closable end cap member may comprise providing an end cap member having engagement means for releasably holding the scoop in the closed position.

The step of affixing the base to the side wall region of the pack may comprise bonding the base to the side wall region.

The step of providing the re-closable cap member may comprise providing a cap member in which the scoop is attached to the base by means of a hinge for movement between the closed and open positions.

The step of providing the re-closable cap member may comprise producing the cap member from cardboard.

The flexible wrapper may comprise a plastic material, preferably PET.

The confectionery pellets may be gum pellets.

In accordance with a third aspect of the invention, there is provided a kit of parts for producing a packaging in accordance with the first aspect or for use in the method of the second aspect, the kit comprising a wrapper for producing the pack and a re-closable end cap, in which the wrapper has a line of weakness arranged so that when the wrapper is formed into a pack about a stack of pellets, the line of weakness at least partially encircles at least part of an end wall region of the pack.

The cap member may be produced from a cardboard blank.

The wrapper may comprise a plastic material, preferably PET.

BRIEF DESCRIPTION OF THE DRAWINGS

An embodiment of the invention will now be described with reference to the remaining drawings in which.

DETAILED DESCRIPTION OF PREFERRED EMBODIMENTS

Packaging 29 for a stack of confectionery pellets 12 in accordance with the invention comprises a pack 30 formed from a flexible wrapper 32 and a re-closable end cap member 34 mounted to one end of the pack. In the present embodiment, the pellets 12 are chewing gum pellets and the pack is tubular with a generally rectangular shape in lateral cross section. It will be appreciated, however, that the shape of the packaging can be varied to suit the shape of the pellets.

Figure 2:
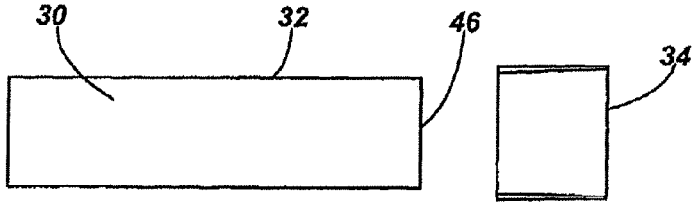
FIG. 2 is a schematic, exploded plan view of a stack of chewing gum pellets enclosed in a wrapper and a cap member forming part of a packaging in accordance with the invention.

The wrapper 32 comprises a sheet of flexible material and may be formed into the tubular pack 30 using any conventional techniques. For example, the sheet may be folded about the stack of pellets and fixed in position using an adhesive to contain the pellets. As illustrated in FIG. 2, the pack 30 is closed at both ends so as to completely enclose the stack of pellets in a conventional manner. Preferably, the wrapper is sealed so that the pellets 12 are protected from the environment until the pack is opened.

The wrapper 32 may be made from any suitable material, including polymeric materials, paper or foil or it may be a composite. In one embodiment, the wrapper in accordance with the invention comprises a single layer of plastics 36 which may be preferably polyethylene terephthalate (PET). In an alternative embodiment, the wrapper may have dual layers of PET with foil underneath.

The end cap 34 is affixed to the pack 30 after it has been formed about the stack. As can be seen best in FIGS. 4B, 4C and 5, the end cap member 34 includes a base 38 and a scoop 40 pivotably mounted to the base by means of a hinge 42. In the present embodiment, the end cap 34 is made from a cardboard blank which is folded and glued into the required shape and the hinge 42 comprises a fold line.

The base 38 is tubular and conforms to the outer profile of the side wall of the pack 30. The base is affixed to the side wall of the pack 30 adjacent one end so that an upper edge 44 of the base lies approximately in the same plane as an end wall region 46 of the pack. The base 38 can be affixed to the side wall of the pack by any suitable method such as by bonding using an adhesive. Where the wrapper 32 comprises an outer layer of plastics such as PET, the base 38 may be heat sealed onto the wrapper.

Figure 3:
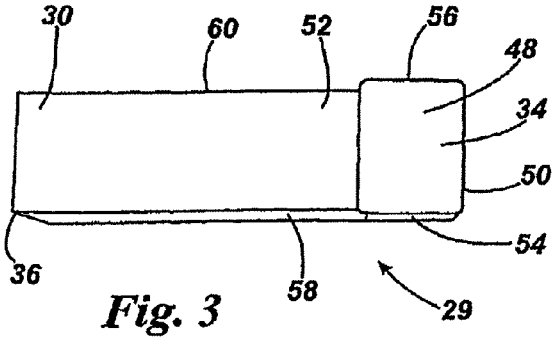
FIG. 3 is a view similar to that of FIG. 2 showing the packaging after a cap member has been affixed to one end of the wrapper.
Figure 4A:
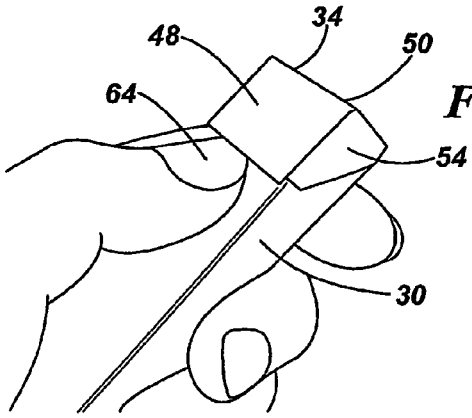
FIGS. 4A to 4D are a series of perspective views illustrating packaging in accordance with the invention being opened and a pellet dispensed.

The scoop 40 has a first main panel 48 which lies generally parallel to and in close proximity with the end wall region 46 of the pack when the scoop is in the closed position, as shown in FIGS. 3 and 4A. The scoop has a second main panel 50 which projects at right angles to the first main panel 48 and which lies generally parallel with and in close proximity to a front face 52 of the pack when the scoop is in the closed position. A pair of side panels 54, 56 extends between the first and second main panels 48, 50 to hold them in their relative positions. The side panels enclose end regions of the scoop and overlie respective side wall regions 58, 60 of the pack when the scoop is in the closed position. As can be seen best in FIGS. 4D and 5, the scoop forms a receptacle into which a pellet from the stack can be dispensed when the scoop is in the open position.

Figure 6:
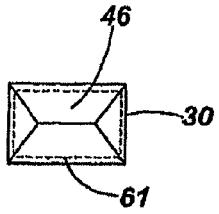
FIG. 6 is an end view of the stack of chewing gum pellets enclosed in a wrapper as shown in FIG. 2.
Figure 1:
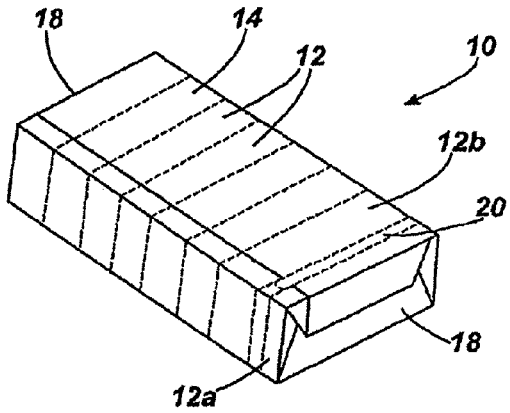
PRIOR ART Fig. 1
FIG. 1 is a perspective view of a stack of chewing gum pellets packaged in a wrapper.

As illustrated in FIG. 6, the wrapper 32 has a line of weakness 61 which is arranged so that it extends about all or part of the end wall region 46 of the pack. When the end cap is mounted to the pack, the scoop is placed in the closed position and the inner surface of the first main panel 48 of the scoop is bonded to the end wall region 46 within the area delineated by the line of weakness. As with the base, any suitable means can be used to bond the inner surface of first main panel 48 to the end wall region such an adhesive which may be heat or pressure activated. Again, if the wrapper 32 comprises a plastics material, the inner face may be sealed to the end wall region. The packaging is presented to the consumer in this manner and the arrangement is such that when the consumer first moves the scoop 40 from the closed position to the open position, the portion of the end wall region 46 which is bonded to the first main panel 48 remains affixed to the first main panel and the wrapper tears along the line of weakness to form an opening in the end of the pack through which the pellets can be dispensed one at a time.

The base 38 and scoop 40 are provided with inter-engaging members that serve to releasably hold the scoop in the closed position. In the present embodiment, the inter-engaging members comprise a locking flap 62 which projects downwardly and outwardly from an upper edge of a front wall portion of the base. The flap 62 is configured to engage with one or more tabs (not shown) on the inner surface of the second main panel 50 of the scoop when the scoop is moved to the closed position. This arrangement holds the scoop 40 in the closed position until a consumer releases the flap 62 from the tab to open the packaging. Advantageously, the releasable closure arrangement can be produced in accordance with the teaching in Swiss patent application CH 534 616 to Zeiler A G, the contents of which are hereby incorporated by reference.

FIGS. 4A to 4D illustrate the sequence of opening the packaging.

Figure 4B:
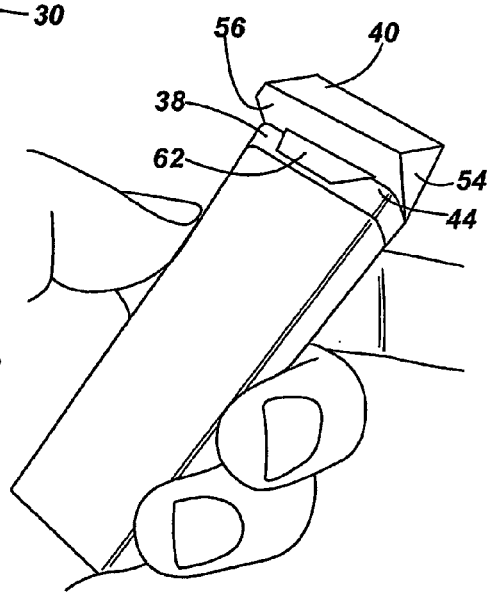
Figure 4C:
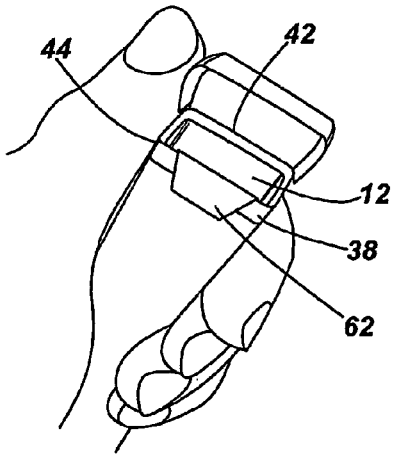
Figure 5:
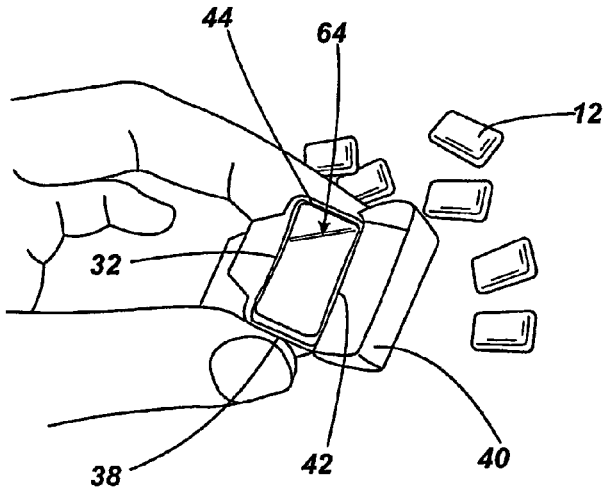
FIG. 5 is a perspective view of an open end of the packaging of FIGS. 4A to 4D with all the pellets removed.

With the scoop 40 in the closed position, a consumer inserts their thumb nail 64 between the second main panel 50 of the scoop and the front face 52 of the pack and deflects the second main panel 50 of the scoop outwardly to release the locking flap 62. The scoop can then be pivoted about the hinge 42 to the open position as illustrated in FIGS. 4B and 4C. As described above, when the package is opened for the first time, the portion of the end wall region 46 bonded to the inner surface of the first main panel 48 of the scoop is torn from the remainder of the package along the line of weakness to create an opening 64 at the end of the pack through which pellets in the stack can be dispensed.

The line of weakness may extend around the entire periphery of end wall region 46 so that the whole of the end wall region is removed when the package is opened, as shown in FIG. 4C. Alternatively, the line of weakness may be configured to that only part of the end wall region 46 is removed or so that the end wall region is only partially removed. For example, a rear edge of the end wall region adjacent the hinge 42 may remain attached to the rear face of the side wall portion of the pack.

Figure 4D:
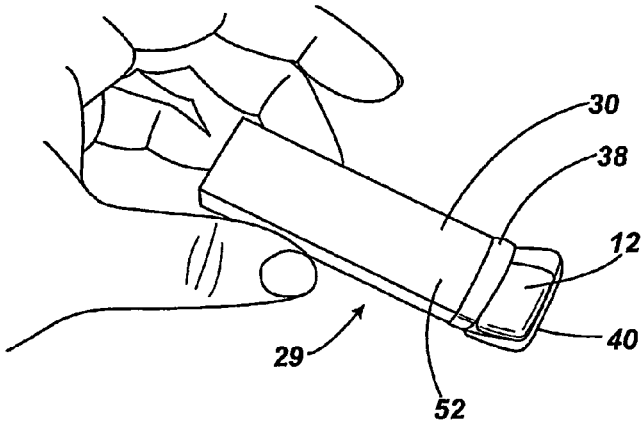

Generally speaking, a consumer would be expected to hold package 29 so that the end cap member 34 is uppermost when opening the scoop 40. However, once the scoop 40 has been opened, the consumer can invert the package 29 so that a pellet slides from within the pack 30 into the scoop 40 under the influence of gravity, as illustrated in FIG. 4D. This provides a very simple and easy method of dispensing the pellets from the stack one at a time.

Once the consumer has dispensed a required number of pellets 12, the package 29 can be re-closed by moving the scoop 40 back to its closed position so that the locking flap 62 re-engages with the tab. In this position, the scoop 40 encloses the open end of the pack and serves as a closure member for securely holding the remaining pellets 12 in the pack 30.

In an advantageous embodiment, the line of weakness is formed in the wrapper by laser etching. However, other methods can be used such as scoring or by means of perforations. Preferably, the line of weakness only extends partway through the wrapper from an inner surface so as not to destroy the integrity of the pack prior to it being opened.

It can be seen that the packaging in accordance with the invention provides a simple and cost effective packaging for a stack of confectionery pellets that is easy to open and which can be effectively re-closed. Because the consumer does not have to fold over the open end of the pack, the pack is more likely to keep its shape, which makes dispensing further pellets easier than with the known packaging. The packaging is particularly suitable for gum pellets.

It is a particular advantage of the invention that the end cap member 40 can be affixed to existing pack arrangements for a stack of pellets without the need to significantly re-design the packs or existing packaging apparatus.

The foregoing embodiments are not intended to limit the scope of protection afforded by the claims, but rather to describe examples as to how the invention may be put into practice.

The invention claimed is:

1. Packaging for a stack of confectionery pellets, the packaging comprising a tubular pack formed from a flexible wrapper which encases the stack and a separately formed reclosable cap member mounted to the pack adjacent one end, the cap member comprising a base affixed to a side wall region of the pack close to said one end and a scoop attached to the base for movement between a closed position in which the scoop encloses said one end and an open position in which said one end is exposed, the scoop being configured to act as a receptacle for holding a pellet dispensed from the pack when in the open position, in which an inside surface of the scoop is bonded to an end wall region of the pack and the wrapper has a line of weakness, the arrangement being such that, on first movement of the scoop from the closed position to the open position, the wrapper tears along the line of weakness to create an opening in the pack through which pellets can be dispensed.

2. Packaging as claimed in claim 1, in which the base and the scoop are configured to releasably hold the scoop in the closed position.

3. Packaging as claimed in claim 1, in which the base is bonded to the side wall region of the pack with an adhesive.

4. Packaging as claimed in claim 1, in which the scoop is attached to the base by a hinge for movement between the closed and open positions.

5. Packaging as claimed in claim 1, in which the cap member is produced from cardboard.

6. Packaging as claimed in claim 1, in which the wrapper comprises a plastic material.

7. Packaging as claimed in claim 1, in which the confectionery pellets are gum pellets.

8. Packaging as claimed in claim 1, in which the wrapper comprises PET.

* * * * *